United States Patent [19]

Fling

[11] 4,226,343

[45] Oct. 7, 1980

[54] VALVING APPARATUS

[75] Inventor: James L. Fling, Portland, Oreg.

[73] Assignee: Custom Systems Associates, Inc., Portland, Oreg.

[21] Appl. No.: 937,061

[22] Filed: Aug. 28, 1978

[51] Int. Cl.[3] ..... B67D 3/04

[52] U.S. Cl. ..... 222/504; 222/505; 251/30; 251/63.4

[58] Field of Search ..... 222/504, 559, 509, 505, 222/517, 518, 43; 251/58, 63.4, 30, 78

[56] References Cited

U.S. PATENT DOCUMENTS

| | | | |
|---|---|---|---|
| 2,511,844 | 6/1950 | Grove | 251/58 |
| 2,640,494 | 6/1953 | Kounovsky | 251/78 |
| 3,221,936 | 12/1965 | Spinuzza | 222/504 |
| 3,294,362 | 12/1966 | Schultz et al. | 222/509 |
| 3,380,629 | 4/1968 | Kontra et al. | 222/504 |
| 3,524,383 | 8/1970 | Locke | 222/504 |

FOREIGN PATENT DOCUMENTS

| | | | |
|---|---|---|---|
| 199630 | 11/1965 | Sweden | 222/504 |

*Primary Examiner*—H. Grant Skaggs

*Attorney, Agent, or Firm*—Kolisch, Hartwell & Dickinson

[57] ABSTRACT

Valving apparatus designed for use in a remote-controlled beer-dispensing system. The apparatus includes a valve having a plunger selectively movable between opened and closed conditions, and a shiftable lever for controlling the position of the plunger. A pneumatic ram is coupled to the lever through a clevis. Upon supply of a pressurized gas to the ram, the clevis impacts the lever, shifting the latter to produce movement of the plunger from its closed to its opened condition. Upon exhaust of gas from the ram, a spring contained in the ram initiates return movement of the lever to produce movement of the plunger from its opened toward its closed condition, primarily under the influence of the spring. The upstream portion of the plunger has a surface which is exposed to and actable on by fluid flowing through the valve—this surface cooperating with the spring to complete movement of the plunger from its opened toward its closed condition. Such completing is primarily under the influence of fluid acting on this surface, whereby the plunger moves toward its closed condition substantially at the rate that fluid flows into and through the valve.

3 Claims, 5 Drawing Figures

VALVING APPARATUS

BACKGROUND AND SUMMARY

The present invention relates to liquid-dispensing apparatus, and particularly to apparatus useful in the remote-controlled dispensing of a foamable liquid such as beer.

In beer-dispensing systems, undesired beer foaming can be minimized by opening the dispensing valve rapidly, and closing the same at a slower rate, substantially that of fluid flow into and through the valve. In manually-operated dispensing systems, such valve operation may be accomplished by use of a beer valve designed to operate between partially opened and fully closed conditions primarily under the influence of fluid flow through the valve. This type of valve may be placed quickly in a fully opened condition through rapid manual operation of a valve-controlling lever. To close the valve, the lever is manually operated to place the valve in a partially opened condition, whereat fluid flow through the valve is effective to produce valve closing, substantially at a rate determined by fluid flow through the valve.

The above-described manual operation contrasts with the operation of remote-controlled beer-dispensing systems known in the prior art. Commonly, such remote-controlled systems employ an in-line solenoid valve designed to produce rapid valve-opening, e.g., within about ten milliseconds. However, the opposite (valve-closing) solenoid movement which occurs at the same speed creates, by such speed, a water-hammer effect on the beer, causing undesired foaming.

The in-line solenoid valve also generates heat during solenoid operation, this heat being partially transferred to the beer, undesirably increasing its temperature and lowering its gas solubility. Also, because the electrical solenoid is located near the bear-dispensing nozzle, the potential for short circuiting and/or electrical shock in the region of the beer dispenser is present.

A general problem associated with beer-dispensing systems is valve sticking, or locking, which may occur after periods of valve disuse, and which results from the sticky residue formed by dried beer. When valve locking occurs, it may be necessary to impact the valve to initiate opening. Impacting is inherently difficult to achieve with the in-line solenoid system of the type mentioned above.

It is an object of the present invention to provide a remote-controlled valving apparatus, the valve of which can be opened rapidly, and closed at a rate which is dependent on the rate of fluid flow through the valve, i.e., which can be operated in a manner similar to the above-described manually-controlled valve.

It is yet another object of the invention to provide a beer-dispensing valving apparatus operable throughout a wide range of liquid-supply pressures.

Another important object of the present invention is to provide a remote-controlled valving device employing a lever-operated valve, wherein the lever is impacted upon initiation of the valve-opening operation.

Still another object of the invention is to provide a liquid valving device which utilizes a conventional type of beer valve by a simple adaptation thereof.

The present invention is gas-controlled valving apparatus includes a valve having a plunger movable between opened and closed conditions, and a shiftable lever operable to move the plunger between such conditions. Attached to the valve is a pneumatic ram or pump operable, upon supply of pressurized gas thereto, to shift the lever to produce movement of the plunger from its closed to its opened position. The pneumatic pump is coupled to the lever by a clevis attached to the pump and dimensioned to permit play in the relative movement therebetween. By this construction, the lever is substantially impacted by the clevis upon initiation of valve opening.

A spring interposed between the pump and the lever, with gas exhausting from the pump, initiates shifting of the lever to produce movement of the plunger from its opened toward its closed condition, primarily under the influence of the spring. Liquid flowing through the valve acts on an upstream surface defined on the plunger, which cooperates with the spring to complete movement of the plunger toward its closed condition—with such completing being primarily under the influence of fluid flow through the valve.

These and other objects and features of the present invention will become more fully apparent when read in connection with the following detailed description of a preferred embodiment of the invention, and the accompanying drawings.

DRAWINGS

DETAILED DESCRIPTION OF A PREFERRED EMBODIMENT OF THE INVENTION

Figure 1:
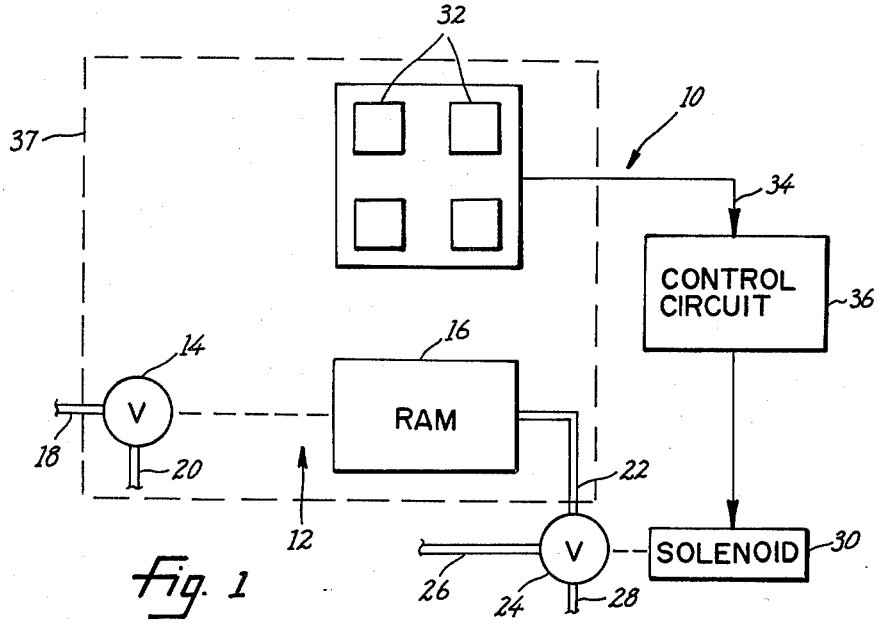
FIG. 1 is a schematic view of a remote-controlled fluid-dispensing system employing the valving apparatus of the present invention.

Turning now to the drawings, and referring first to FIG. 1, indicated generally at 10 is a liquid-dispensing system employing valving apparatus 12 constructed in accordance with the present invention. System 10 herein is used for the dispensing of beer, and apparatus 12 includes a conventional lever-operated beer-dispensing valve 14 which is actuated, according to the invention, by a pneumatic ram 16. More specifically, and as will be more fully explained, ram 16 is actuated to open valve 14, and a spring (not shown in FIG. 1), which works in conjunction with the ram, effects initial closing of the valve.

Beer under pressure is supplied valve 14 through a conduit 18, and the dispensing nozzle in the valve is shown at 20. Air or gas for actuating ram 16 is supplied the same through a conduit 22 which connects with a two-position solenoid-controlled valve 24. Also connected to valve 24 are a conduit 26 connected to a suitable source of pressurized air or gas, and an exhaust conduit 28 whose function will be explained shortly. The specific position or condition occupied by valve 24 is determined through operation of a conventional solenoid 30 which is gauged to the valve. In one operating condition for valve 24 the same conduits 22, 26, and in the other condition therefor the same connects conduits 22, 28.

Dispensing of beer in system 10 herein is effected through the operation of one of four push buttons shown generally at 32 in FIG. 1. These push buttons are suitably connected through conductors represented by a line 34 with a control circuit 36, the output of which connects with solenoid 30. An arrangement including push buttons, like push buttons 32, and a control circuit, like control circuit 36, is conventional, and has been used in the past to initiate the dispensing of liquid through a valve. Hence details thereof are not necessary herein.

Completing a description of what is shown in FIG. 1, valve 14 and ram 16 are contained within a protective housing 37, a portion of which is represented by dashed-dot lines, and push buttons 32 are suitably mounted in an exposed fashion on this housing.

Figure 3:
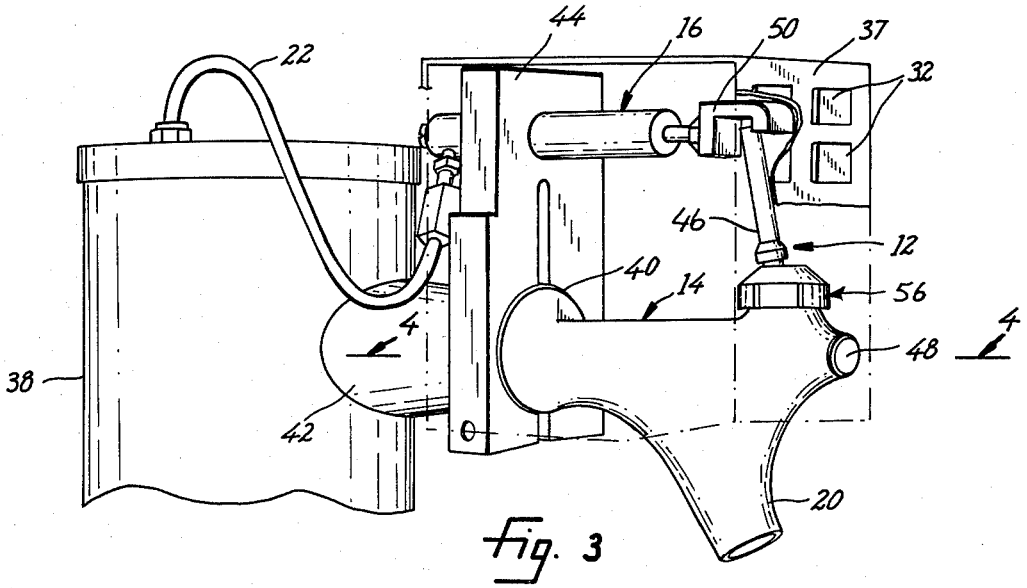
FIG. 3 is a perspective view of the valving apparatus constructed according to the present invention, shown attached to a portion of a support tower.
Figure 4:
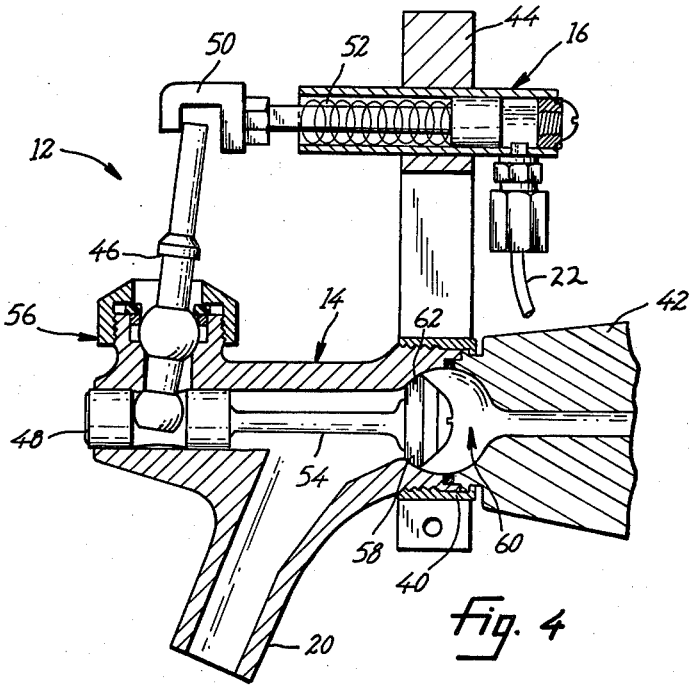
FIG. 4 is a sectional view of the invention, with the valve therein shown in a closed condition—the view being taken generally along the line 4—4 in FIG. 3.
Figure 5:
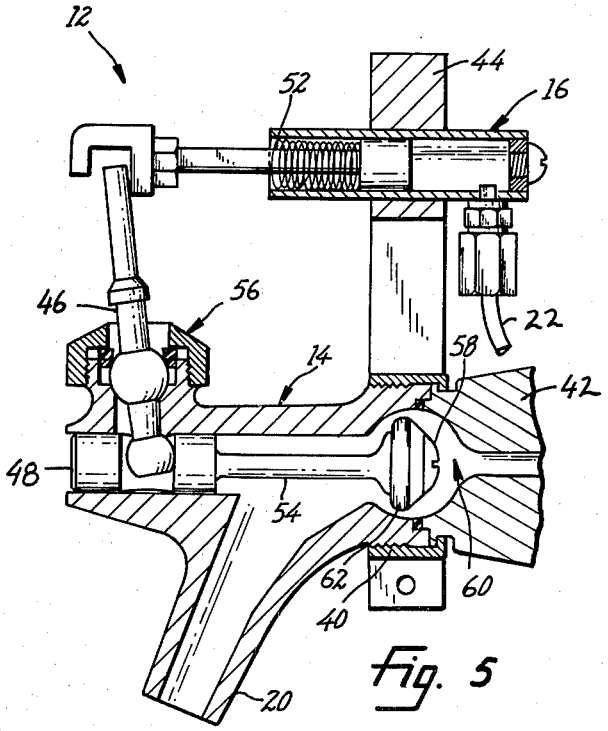
FIG. 5 is a view similar to FIG. 4, showing the valve in an opened condition.

Considering FIGS. 3, 4 and 5 in the drawings, FIG. 3 shows how the apparatus of the invention might typically be mounted for use. FIGS. 4 and 5 show internal details of the valve and ram used in the invention, and of the interconnections therebetween—with these parts shown in two different operating conditions.

Considering what appears in FIG. 3, here the configurations and relative positions of the parts in apparatus 12 are shown. Speaking in general terms, these parts in the apparatus are supported adjacent the upper end of a conventional beer-dispensing valve support tower 38 which mounts on a countertop or the like. In particular, valve 14 is fastened through a nut 40 on the outer end of a fluid-supply projection 42 which extends radially from the side of tower 38. Ram 16 is positioned above valve 14, and is held in place through a mounting unit 44 which, in system 10, is clamped onto nut 40.

As was previously mentioned, valve 14 is lever-actuated, and shown at 46 in FIG. 3 is the upwardly extending actuating lever for the valve. It might be noted that valve 14, in addition to being primarily lever-actuatable, is also actuatable through the operation of a forwardly projecting conventional plunger button 48.

As has already been mentioned, ram 16, like valve 14, is entirely conventional in construction. More specifically, ram 16 is a single-acting ram whose butt end connects with previously mentioned conduit 22, and whose rod is fitted with a somewhat U-shaped inverted clevis, or clevis means, 50 which extends as shown over the top end of lever 46. How the clevis and the lever interact herein will be explained shortly.

Further describing the construction of ram 16, provided therein is a compression-biasing spring means or spring which, while concealed in FIG. 3, appears at 52 in FIGS. 4 and 5. This spring, which is also referred to herebelow as a second actuator, acts between the outer end of the cylinder in the ram and the piston thereof which is carried on the inner end of the rod. This arrangement is evident in FIGS. 4 and 5.

In FIG. 3, the parts in valve 14 and those in ram 16 which are evident in the figure are shown in the positions which they occupy with valve 14 closed. Lever 46 is slightly rearwardly inclined, and ram 16 is in a fully retracted condition. To open valve 14, pressurized gas is supplied the butt end of the cylinder in ram 16 thereby causing the ram to extend. Clevis 50, in a manner still to be more fully explained, acts against lever 46 to open the valve. With the butt end of the ram exhausted, and as also will be more fully explained, spring 52 initiates retraction of the ram and closing of valve 14. Complete closing of the valve, according to an important feature of the invention still to be developed, takes place under the combined effort of spring 52 and the terminal flow of beer through the valve as the same is closing.

Completing now a description of the general arrangement shown in FIG. 3, previously mentioned housing 37 is shown fragmentarily and partially in phantom lines to indicate how it sits over and about valve 14, ram 16, and unit 44. As can be seen, the housing substantially completely encloses the valve and ram, with nozzle 20 extending below the housing, and plunger button 48 projecting through a suitable accommodating bore on the adjacent side of the housing. Previously mentioned push buttons 32 are mounted in an exposed fashion immediately above the plunger button.

While it is probably quite apparent, it should be noted that tower 38 contains the fluid and gas plumbing for valve 14 and ram 16, respectively, as well as the cabling containing the necessary conductors which connect with push buttons 32.

Turning now more specifically to FIGS. 4 and 5, as has already been noted, the former shows the condition with valve 14 closed, and the latter shows the condition with the valve opened. The parts which make up valve 14, and the respective configurations thereof, all of which are conventional, are believed to be clearly apparent from what is shown in FIGS. 4 and 5. Consequently, only those portions of these parts and configurations which are necessary to an understanding of the construction and operation of the present invention will be discussed specifically.

Provided in what might be thought of as the central axial passage extending through the body of valve 14 is a reciprocable plunger 54, the left end of which in FIGS. 4 and 5 has a reduced cross-section region which engages in a known manner with the bifurcated lower end of lever 46. The lever is supported for limited rocking in a sealing and clamping assembly 56 which forms part of valve 14. More specifically, the lever is permitted to rock slightly from left to right in FIGS. 4 and 5 and substantially in the plane of these figures. The right end of plunger 54 is formed with an enlargement 58 which is captured within a somewhat spherical chamber 60 that forms part of the central passage in the body of the valve, and which, more specifically, is located toward the right end of this passage in FIGS. 4 and 5. The right side of enlargement 58 in FIGS. 4 and 5 forms a surface which is exposed to and actable upon by fluid flowing into and through the valve, in a manner to be described. Forming part of enlargement 58 is an annular seal 62 which is adapted to seat against the left side of chamber 60, when the plunger is in a closed condition, as shown in FIG. 4, to block the flow of beer through the valve.

With the parts in valve 14 as shown in FIG. 4, namely, with the valve closed, lever 46 occupies the inclined position shown in this figure, with clevis 50 overriding but out of contact with the upper end of the lever. Ram 16 is in a fully retracted state, and is held therein through the action of spring 52.

When it is desired to open the valve, for example to dispense a predetermined volume of beer, one of the three push buttons mentioned earlier which accomplishes this is depressed, whereupon valve 24 switches to a condition connecting conduits 22, 26. Immediately, pressurized gas is supplied the butt end of ram 26, and the ram extends. Still with reference to FIG. 4, it will be noted that prior to extension of the ram from the condition in which it is shown in FIG. 4, there is an appreciable gap between the right side of the upper end of lever 46 in the figure and that portion of clevis 50 which extends downwardly and adjacent this side of the lever. As a consequence of this important relationship, the clevis, with extension of the ram, slams into or impacts the upper end of the lever, substantially after the rod in the ram has accelerated to its full travel speed. The result of this is an extremely rapid shifting of the valve lever to cause rapid movement of plunger 54 to an opened condition and opening of valve 14. With the apparatus constructed as shown herein, from the moment that a push button is depressed (calling for the dispensing of beer), complete opening of valve 14, i.e., movement of the plunger from its closed to its opened condition, occurs typically as rapidly as within about 12-milliseconds.

Figure 2:
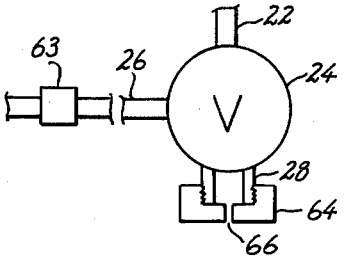
FIG. 2 is a schematic view of a solenoid valve used in a modified form of the present invention.

The force by which ram 16 moves valve 14 to an opened condition depends in part on the pressure of gas supplying the ram. As mentioned above, ram 16 is supplied by a source of pressurized gas or air connected to valve 24 through conduit 26. Turning to FIG. 2, there is shown regulator means including a gas pressure regulator 63 interposed between such source (not shown) and conduit 26. Regulator 63 is adjustable to vary the pressure of air gas supplied to valve 24, and hence the force by which ram 16 acts against lever 46 to place plunger 54 in an opened condition.

With plunger 54 in its opened condition and the valve opened, the parts therein, and in ram 16, occupy positions like those shown in FIG. 5. Here, it will be noted that clevis 50 is engaged with the upper end of lever 46, with the latter holding plunger 54 in a position with enlargement 58 opening chamber 60 to the passage of beer through the valve.

It will thus be apparent that two of the important objectives of the present invention are clearly met during the opening operation for valve 14. More specifically, the valve is opened extremely rapidly, with such rapid opening being especially accommodated by the impacting action which occurs between the clevis and the upper end of the valve lever. In other words, shifting of the valve plunger to open the valve takes place after the rod in the ram has substantially reached its full travel speed. Dispensing of beer then takes place in the usual fashion, and in the case of a timed dispensing operation, valve 24 is held open throughout a predetermined time interval, therein valve 14 is held opened by virtue of the fact that pressurized gas is maintained in the butt end of the cylinder in ram 16.

Secondly, by varying the pressure of compressed air supplied to ram 16, the device can be adjusted to operate in the manner described above over a wide range of liquid-supply pressures. This feature becomes important when liquid is supplied to valve 14 at higher-than-normal pressures, wherein the pressure of gas supplied to ram 16 is suitably raised.

At the end of the beer-dispensing time interval, control circuit 36 actuates solenoid 30 to place valve 24 in a condition interconnecting conduits 22, 28. When this occurs, the butt end of the cylinder in the ram is exhausted to the atmosphere, and biasing spring 52 initiates retraction of the ram. This results in the left-side, downturned portion of clevis 50 in FIG. 5 striking the upper end of lever 46, and initiating closure of valve 14. At this stage during closing of the valve, the closing operation is primarily under the influence of spring 52. With return actuation of lever 46, plunger 54 begins to shift to the left in FIG. 5. At a certain point in the return travel of the plunger, wherein the plunger is in what is referred to herein as a partially opened condition, the pressure of fluid acting on the right side of enlargement 58 is enough (in excess over the frictional resistance to movement within the valve of the plunger and the lever) to cause completion of closure of the valve primarily under the influence of liquid pressure acting on such side. Since, as this action is taking place, beer continues to flow through the valve at a rate determined by the supply pressure for the beer, completion of closure-travel for the plunger takes place with the plunger moving at substantially the same speed with which beer continues to flow into and through the valve. In other words, at this stage in the closure operation of the valve, while biasing spring 52 still continues to have an influence, the primary influence is now the continued flow of beer into the valve. An important result of this is that enlargement 58 re-seats against the left side of chamber 60 in FIG. 5 in a gentle rather than in a slamming fashion.

It may be desirable, under some circumstances, to control the rate at which spring 52 and fluid flow through the valve moves the plunger toward its closed condition. Such might be the case, for example, where the pressure of liquid supplied valve 14 is substantially higher than what is considered to be a normal fluid pressure of about 15-psi. At the higher pressure, the pressure differential across the upstream and downstream sides of enlargement 58 may produce an undesirably high rate of movement of the plunger toward its fully closed position, causing a water-hammer effect. As can be appreciated with reference to FIG. 5, the movement of plunger 54 to the left is constrained by the movement of the ram piston in the opposite direction. To a certain extent, the impedance of ram 16 due to friction and exhausting gas will tend to retard the motion of the plunger toward its closed condition even when the ram is rapidly evacuated. The impedance of the ram can be correspondingly increased by decreasing the rate of gas exhaustion therefrom, which in turn, causes the movement of plunger 54 toward its closed condition under the influence of fluid flow to be correspondingly reduced.

Means for controlling the rate of exhaust of pressurized gas from ram 16 is illustrated in FIG. 2, and basically includes means for reducing the rate of flow of exhaust gas through exhaust conduit 28. As illustrated, such means may take the form of a bleeder cap 64 attached to the outer end of conduit 28 for restricting the rate of gas exhaust therethrough. Cap 64 is threadably attached to the end of conduit 28 conventionally, and provides a relatively small gas-escape opening 66 through which pressurized gas from ram 16 escapes when valve 24 is switched to a condition connecting conduits 22, 28.

It will now be apparent that the above-described valving apparatus functions to open and close beer valve 14 in a manner which closely approximates the manual operation of this valve. In particular, ram 16, coupled to the valve through clevis 50, is operable to open the valve rapidly, with the force of valve opening and closing being readily adjustable to accommodate different pressures of liquid supplying valve 14. Secondly, spring 52 which is compressed in the valve-opening operation, serves to initiate valve closing by initiating movement of the plunger toward its closed condition, with completing of such movement being primarily under the influence of liquid flow into and through the valve.

In the instant gas-controlled valving apparatus, electronic control of the operation of the valve is effected by the switching of solenoid-operated valve 24 between its positions connecting conduits 22, 28 and 22, 26. Because valve 24 is physically separated from the liquid-dispensing region of the apparatus, which includes valve 14 and ram 16, problems of heat conduction between a solenoid valve and the liquid to be dispensed are avoided, as are potential problems of short-circuiting and electrical shock in the region of the beer-dispensing head.

A further advantage of the present invention is the ease with which a conventional beer valve, such as valve 14, may be adapted for attachment thereto of ram 16, to form the gas-controlled valving system of the present invention. More particularly, valve 14 may be so adapted by placing unit 44 on nut 40, and by orienting the unit so that the upper portion of lever 44 is received with the downturned channel in clevis 50, as shown and described above.

While a preferred embodiment, and a modification, of the present invention have been described, various other modifications and changes may be made without departing from the spirit of the invention.

It is claimed and desired to secure by Letters Patent:

1. In combination with a fluid-dispensing valve having a plunger movable selectively between opened and closed conditions, said plunger defining a surface which is exposed to and actable upon by fluid flowing through said valve to move said plunger, when such is in a partially opened condition intermediate its closed and opened conditions, to its closed condition, with such movement occurring at substantially the same rate that fluid flows into and through said valve, apparatus useable to move said plunger from its closed toward its opened condition at a first overall rate, and from its opened toward its closed condition, at a second, substantially slower overall rate, said apparatus comprising, a pneumatically controlled ram operatively connected to said plunger, operable to move the same from its closed toward its opened condition, at said first rate, upon supply of gas to said ram, at a selected pressure and spring means operatively connected to said plunger, upon exhaust of gas from said ram, operable to produce shifting of the latter from its closed toward its said partially opened condition, whereupon plunger movement from said partially opened condition toward its closed condition occurs primarily under the influence of fluid acting on said surface.

2. The combination of claim 1 which further includes exhaust control means for limiting the rate of exhaust gas from said ram, thus to limit the rate of movement of said plunger from its opened toward its closed condition.

3. The apparatus of claim 1 which further includes clevis means operatively coupling said ram and said plunger, and dimensioned to permit play therebetween, wherein said clevis means may be placed in motion, by operation of said ram, before operatively contacting said plunger, thus to impact said plunger when the same is to be moved from its closed toward its opened condition.

* * * * *

UNITED STATES PATENT AND TRADEMARK OFFICE

CERTIFICATE OF CORRECTION

PATENT NO. : 4,226,343

DATED : October 7, 1980

INVENTOR(S) : James L. Fling

It is certified that error appears in the above—identified patent and that said Letters Patent is hereby corrected as shown below:

Column 8, line 22, after "exhaust", second occurrence, insert -- of --.

Signed and Sealed this

*Thirteenth* Day of *January 1981*

[SEAL]

*Attest:*

SIDNEY A. DIAMOND

*Attesting Officer*

*Commissioner of Patents and Trademarks*